United States Patent [19]

Silberstein

[11] Patent Number: 4,984,798

[45] Date of Patent: Jan. 15, 1991

[54] COMPOSING PLANE FOR TWO-SIDED PUZZLES

[76] Inventor: Beniamino Silberstein, Via Laviano, Parco Spazio - 81100 Caserta, Italy

[21] Appl. No.: 434,686

[22] PCT Filed: Mar. 7, 1989

[86] PCT No.: PCT/IT89/00012

§ 371 Date: Oct. 30, 1989

§ 102(e) Date: Oct. 30, 1989

[87] PCT Pub. No.: WO89/08485

PCT Pub. Date: Sep. 21, 1989

[30] Foreign Application Priority Data

Mar. 8, 1988 [IT] Italy ..... 35579/88[U]

[51] Int. Cl.[5] ..... A63F 9/10; B65D 6/00

[52] U.S. Cl. ..... 273/157 R; 206/315.1; 220/377; 220/326; 220/4.21; 40/156

[58] Field of Search ..... 273/157 R, 157 A, 148 R; 206/315.1, 564, 579; 220/377, 324, 326, 4 B–4 E; 40/152, 156, 661

[56] References Cited

U.S. PATENT DOCUMENTS

| | | | |
|---|---|---|---|
| 1,789,782 | 1/1931 | Shockley | 273/157 R |
| 2,016,942 | 10/1935 | Horwitt et al. | 40/152.1 |
| 2,232,504 | 2/1941 | Zell | 220/4 B X |
| 2,984,489 | 6/1961 | Pariato | 273/157 R |
| 3,504,915 | 4/1970 | Walker | 273/157 R |
| 4,111,425 | 9/1978 | Lathrop | 273/157 R |
| 4,302,013 | 11/1981 | Kavis | 273/157 R |
| 4,337,590 | 7/1982 | Jackson | 40/661 X |
| 4,436,307 | 3/1984 | Caldwell | 273/157 R |
| 4,479,651 | 10/1984 | Lafleur | 273/157 R |
| 4,486,018 | 12/1984 | Keller, Jr. | 273/157 R |
| 4,552,361 | 11/1985 | Lafleur | 273/157 R |

FOREIGN PATENT DOCUMENTS

| | | | |
|---|---|---|---|
| 1603079 | 1/1971 | Fed. Rep. of Germany | 273/157 R |
| 2385420 | 12/1978 | France | 273/157 r |
| 2203056 | 10/1988 | United Kingdom | 273/157 R |

*Primary Examiner*—Edward M. Coven
*Assistant Examiner*—Sebastiano Passaniti
*Attorney, Agent, or Firm*—Roylance, Abrams, Berdo & Goodman

[57] ABSTRACT

An assembly and display device for the playing pieces of a two sided puzzle having first and second sheets formed from a transparent material in which the sheets are provided with complimentary first and second sidewalls along at least two contiguous sides and are further provided with a spring mechanism for fastening the sheets in a closed position. A support member is fixable to the sheets and serves to hold the device in an upright fashion for displaying the completed puzzle.

3 Claims, 2 Drawing Sheets

1
2
3
4
5
6
7
8
9
10
11
12

COMPOSING PLANE FOR TWO-SIDED PUZZLES

DISCLOSURE OF THE INVENTION

This invention releates to a composing plane for two-sided puzzles.

More particularly, this invention relates to a composing and supporting plane for games of patience such as for instance puzzles in which the composition of the figures can be performed on both sides of the game.

As is well known, such type of game essentially consists in recreating, by means of reciprocal fitting of small pieces in one another, a complete figure.

In games already known at the present time, such figure is formed on one of the two sides of the sheet that makes up the game, and that is divided accordingly into small pieces, so that each one of said pieces bears, on one side, a portion of the image that is to be reconstituted and, on the opposite side, a paper support of any color.

Such type of game of patience is generally composed by employing, as a supporting plane, very different kinds of supports such as the covers of the boxes, or tables, boards or planks . . . according to the size of the game itself.

Moreover, said game, once it is composed, must lie on a horizontal plane to avoid becoming undone and generally it is to be stored within boxes or similar containers in which it is quite hard to look at the final composition and to appreciate its beauty.

Moreover, it is well known that in the field of games of patience such as for instance puzzles, not only children but also adults love to put themselves to test, aiming at the creation and composition of images of ever increasing complexity and having an ever increasing number of details and of pieces into which the whole figure is subdivided.

One of the main complications is represented by the prearrangement of sheets on which the images to be composed are formed on both sides of the game, so that the action of composing the figure can be performed simultaneously on both parts.

One of the main problems met with in such type of composition is due to the need for having at disposal a suitable support so as to control the progress of the puzzle on both sides and so the puzzles, once it has been composed, can be shown for ornamental and decorative purposes indifferently from both sides.

In order to satisfy such requirement, the present invention suggests the realization or a composing plane for puzzles, perferably for two-sided puzzles, which is made up of a transparent material and consists of two complementary sheet members provided with side walls or stops and with checking means, which memebers can be opened so as to allow the composition to be performed on one side, and then can be closed again so as to obtain, through overturning, the transfer of the whole set of pieces of the inner side of one of the two sheets to the inner side of the other sheet, so that the composition of the game can be continued on the opposite side.

Accordingly, it is a specific object of the present invention a composing plans for two-sided puzzles, said plane being charactierized in that it comprises a first and a second transparent material sheet, first longitudinal side-wall means being provided on the inner side of said first and second sheet in order to enclose and contain the small pieces of the game; second longitudinal means being provided in a direction parallel to that of said first longitudinal side-wall means at the points corresponding to at least two contiguous sides of said first and said second sheet; said first longitudinal side-wall means and said second longitudinal side-wall means making up a continuous cavity intended for engagement with said first side-wall means provided on the inner surface of the complementary sheet; spring means being provided on said first side-wall means for fastening the upper and lower sheets at a closed position; a hole being provided at the point corresponding to the outer perimeter of each one of the sides of said upper and lower sheets for hanging said composing plane, According to a preferred embodiment of the composing plane of the present invention, a supporting member can be associated to said holes provided at the points corresponding to said perimeter edges.

The present invention will be disclosed in the following just for illustrative and not for limitative purposes with reference to the enclosed drawings wherein.

Figures 1, 2:
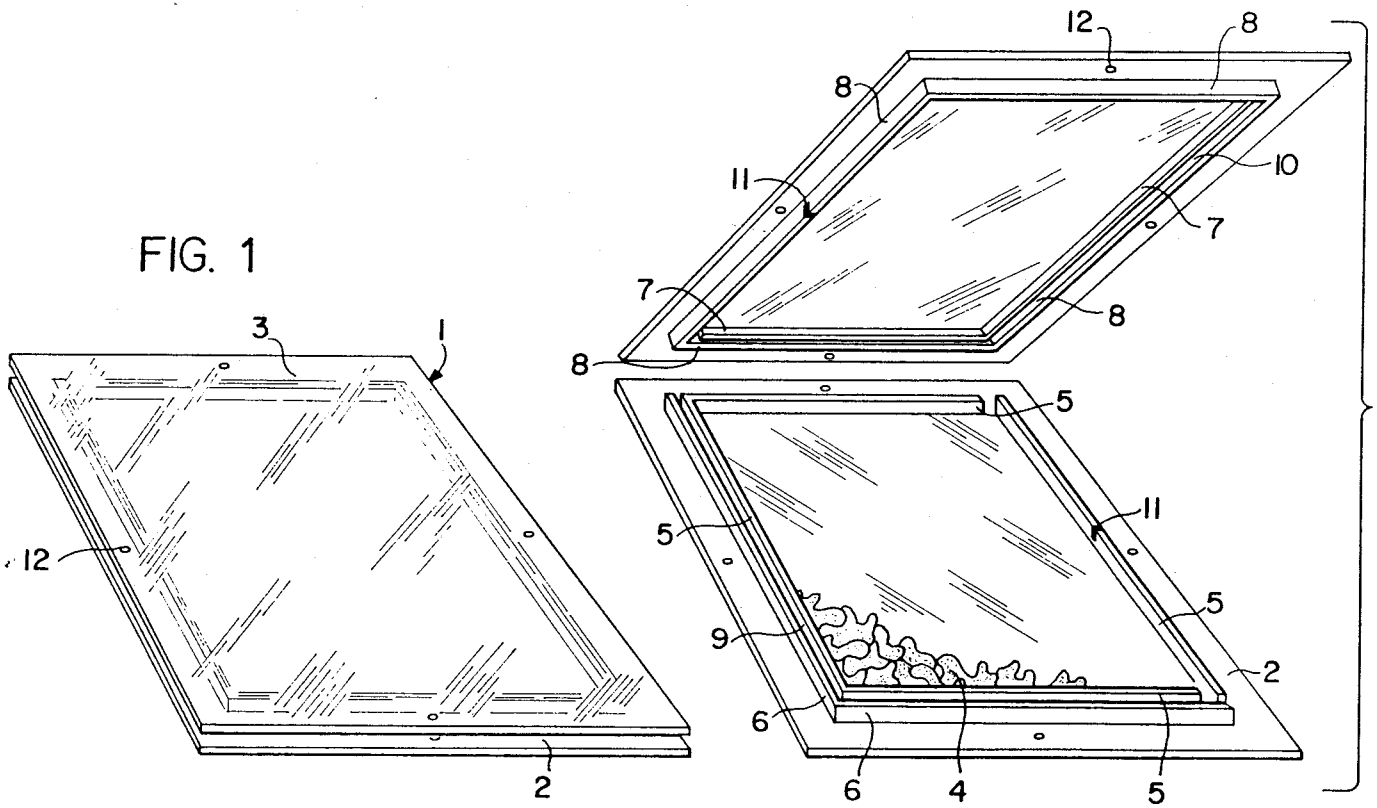
FIG. 1 shows a perspective view of the composing plane in the closed position.
FIG. 2 shows a perspective view of the composing plans in the open position.

As can be observed in FIG. 1, the composing plane 1 for two-sided puzzles is made up of a first sheet 2 and of a second sheet 3 where shape is substantially rectangular, both sheets having the same sizes.

Such sheets are made up of a transparent material so that the images which are gradually composed through fitting the pieces of the puzzle 4 in one another can be observed and appreciated.

In FIG. 2, the sheets 2 and 3 are shown in the open position, so that both the inner longitudinal side-all means 5 and the outer longitudinal side-wall means 6 can be clearly seen, all of them being arranged on the sheet 2 like the inner longitudinal side-wall means 7 and the outer longitudinal side-wall means 8 of the sheet 3.

The inner side-walls provided along the edges of each one of the two sheets are so arranged as to prevent the puzzle pieces from sliding out of the support both during the composing phase and when the game has been completed.

The aarrangement of the outer side-walls has been designed, on the contrary, so that, while the side-walls 5 and 6 of the sheet 2 form at the points corresponding to two contiguous sides the cavity 9 for accommodating the outer side-walls 8 of the sheet 3, the side-walls 7 and 8 form, at the points corresponding to two contiguous sides of the sheets 3 which are opposite to the preceding ones, a cavity 10 for accommodating the inner side walls 5 of the sheet 2.

Figure 3:
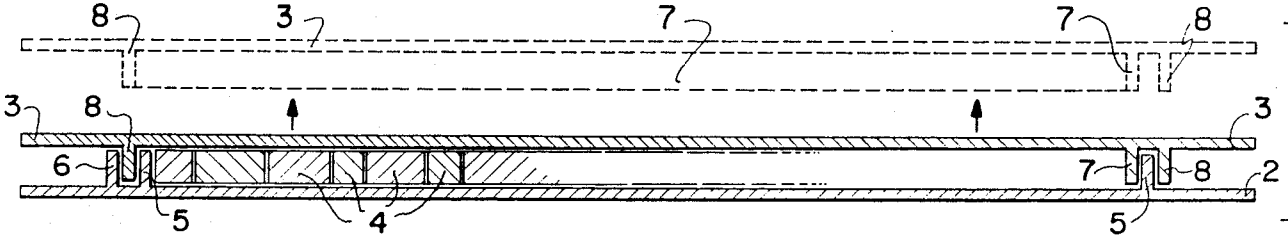
FIG. 3 shows a vertical cross-sectional view of the composing plane of FIG. 1 in the closed and the open position in dashed line.

Thus, when the two sheets are overlapped on one another, the configuration shown in FIG. 3 is formed, wherein the sheet 3 is shown both in the closed position and, in dashed line, in the raised position.

Accordingly, as can be remarked the side-walls 5 and 6 of the sheet 2 engage with side-wall 8 of the sheet 3, while the side-walls 7 and 8 of the sheet 3 engage with side-wall 5 of the sheet 2.

Figure 5:
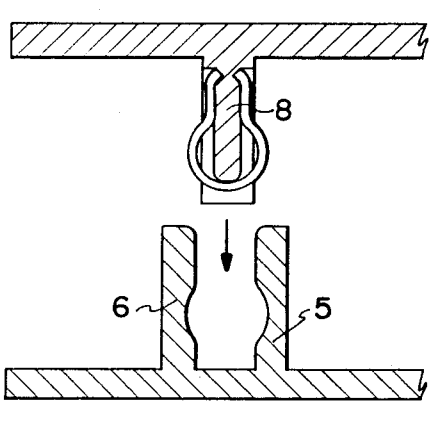
FIG. 5 shows an enlarged vertical cross-sectional view of the locking system of the sheets, in the open position.
Figure 4:
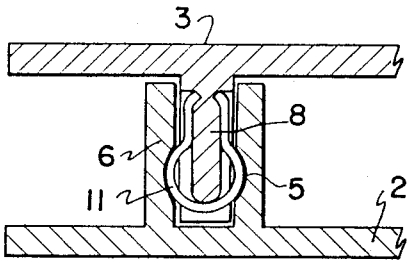
FIG. 4 shows an enlarged vertical cross-sectional view of the locking system of the upper and lower sheets in the closed position.
Figure 8:
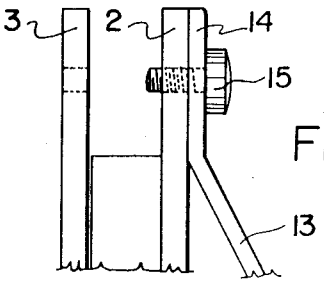
FIG. 8 shows a detail on an enlarged scale of the hooking system of the supporting member with one of the two sheets of the plane.

FIGS. 4 and 5 show a detail of the system for fastening the two sheets 2 and 3 by means of a spring 11 which is associated respectively to lthe side-walls 5 and 8 and is intended for being housed within the corresponding cavity provided in the inner surface of the side-walls 5 and 6.

Figure 7:
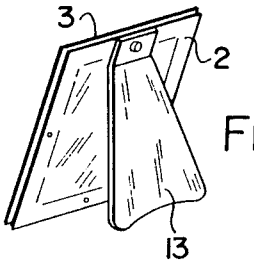
FIG. 6 and 7 show respectively a side perspective view and a rear-side view of the composing plane joined to a supporting member.
Figure 6:
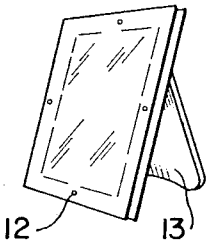

FIGS. 6 and 7 shown on the contrary the composing plane 1 in the closed position, to which plane a support 13, substantially triangular in shape, is associated at a point corresponding to one of the holes 12 provided in each of the two sheets 2 and 3, said support having in its upper part a plate-like portion 14 that overlaps the sheet 2 (or 3) so that it can be joined to the same through a threaded screw 15, The present invention has been disclosed just for illustration and not for limitative purposes, according to some preferred embodiments of the same, but it is to be understood that modifications and/or changes can be introduced by those who are skilled in the art without departing from the spirit and scope of the invention for which a priority right is claimed.

I claim:

1. A composing plane for containing the playing pieces of a two-sided puzzle, comprising:

first and second planar sheets; each sheet having a generally rectangular four-sided configuration and formed from a transparent material;

first longitudinal sidewall means provided on one surface of each of said first and said second sheets for containing the pieces of the puzzle; said first longitudinal sidewall means formed generally along and spaced inwardly from the perimeter of at least two sides of each of said first and said second sheets;

second longitudinal sidewall means spaced from and extending generally in a direction parallel to said first longitudinal sidewall means along at least two contiguous sides on the surface of each of said first and said second sheets;

said first longitudinal sidewall means and said second longitudinal sidewall means forming a continuous elongated cavity on the surface of at least one of said first and said second sheets for providing complimentary engagement with the first longitudinal sidewall means located on at least the other of said first and said second sheets;

spring means for fastening said first and said second sheets in a closed position; and at least one through hole for engagement with a supporting member for displaying said composing plane; said through hole being provided at a point proximate the outer perimeter of at least one of the sides on each of said first and said second sheets.

2. A composing plane according to claim 1 wherein said hole is threaded.

3. A composing plane according to claim 1 wherein said supporting member has an upper part and a lower part and is substantially triangular in shape; said upper part being generally flat.

* * * * *